US008770728B2

(12) United States Patent
Motoyama

(10) Patent No.: US 8,770,728 B2
(45) Date of Patent: Jul. 8, 2014

(54) IMAGE FORMING DEVICE

(71) Applicant: Nobuhiko Motoyama, Kanagawa (JP)

(72) Inventor: Nobuhiko Motoyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/669,683

(22) Filed: Nov. 6, 2012

(65) Prior Publication Data

US 2013/0135414 A1 May 30, 2013

(30) Foreign Application Priority Data

Nov. 25, 2011 (JP) ..... 2011-257096

(51) Int. Cl.
*B41J 2/175* (2006.01)

(52) U.S. Cl.
USPC ..... 347/85; 347/84; 347/86

(58) Field of Classification Search
USPC ..... 347/84–86
See application file for complete search history.

(56) References Cited

U.S. PATENT DOCUMENTS

| | | | | |
|---|---|---|---|---|
| 4,893,137 | A | 1/1990 | Ebinuma et al. | |
| 5,043,746 | A * | 8/1991 | Abe | 347/85 |
| 5,473,354 | A * | 12/1995 | Arquilevich et al. | 347/85 |
| 5,602,577 | A * | 2/1997 | Shibata et al. | 347/84 |
| 6,003,981 | A * | 12/1999 | Cameron et al. | 347/85 |
| 6,007,190 | A * | 12/1999 | Murray et al. | 347/86 |
| 6,247,802 | B1 | 6/2001 | Gasso | |
| 7,775,629 | B2 | 8/2010 | Nukui et al. | |
| 2004/0046840 | A1 | 3/2004 | Benson et al. | |
| 2005/0024449 | A1 | 2/2005 | Shiho et al. | |
| 2005/0140752 | A1 * | 6/2005 | Shiho et al. | 347/85 |
| 2008/0111869 | A1 | 5/2008 | Kumagi et al. | |

FOREIGN PATENT DOCUMENTS

| | | |
|---|---|---|
| EP | 18496102 A2 | 10/2007 |
| JP | 2641200 | 8/1997 |
| JP | 2007-176068 | 7/2007 |
| JP | 2007-176115 | 7/2007 |
| JP | 2008-149647 | 7/2008 |
| JP | 4671884 | 4/2011 |

OTHER PUBLICATIONS

European Search Report dated Feb. 8, 2013 in connection with counterpart European patent application No. 12 19 1291.9.

* cited by examiner

*Primary Examiner* — Henok Legesse
(74) *Attorney, Agent, or Firm* — Cooper & Dunham LLP

(57) ABSTRACT

Disclosed is an image forming device including a carriage including recording heads and sub-tanks; a platen having a conveyance surface; flexible tubes for supplying liquids to the sub-tanks, the flexible tubes being extended along a main scanning direction above the platen, wherein extended portions of the flexible tubes are folded at middle portions of extended portions in the main scanning direction; first and second tube guides that support the folded extended portions of the flexible tubes, wherein the flexible tubes are arranged in a height direction, wherein the first tube guide is disposed at a position higher than that of the second tube guide, and wherein the tubes are supported by a thin plate-like sheet member formed of an elastic material.

6 Claims, 10 Drawing Sheets

IMAGE FORMING DEVICE

BACKGROUND OF THE INVENTION

1. Field of the Invention

An embodiment of the present invention relates to an image forming device. Specifically, the embodiment relates to an ink supplying unit that is used for an inkjet recording device.

2. Description of the Related Art

For an inkjet recording device that is used for a printer, a facsimile machine, a copier, and a plotter as a single image forming device, the following configuration has been known. Namely, the configuration is for supplying ink from a main tank disposed in a device main body to a sub-tank disposed above a carriage. The sub-tank is a small capacity tank (a liquid container) for supplying ink, which is a liquid, to an inkjet head that is a liquid discharge head. The main tank is a large capacity ink cartridge that is a liquid reservoir tank.

In the configuration using the sub-tank, it is not necessary to mount a large ink tank on the carriage. Therefore, the configuration has advantages such that the power load for moving the carriage is reduced and oscillation caused by movement of the carriage is reduced.

The ink cartridge and the sub-tank disposed at the side of the carriage are connected through tubes. For example, a configuration has been adopted in which flexible tubes are utilized. The flexible tubes can follow the movement of the carriage, and the tubes themselves can also be moved. The tubes are extended along a main scanning direction in which the carriage moves. End portions of fluid channels of the tubes are connected to the main tank and the sub-tank, respectively. The tubes are folded at middle portions between the end portions. It looks like a U-shape in a planer view (e.g., Patent Document 1 (Japanese Registered Patent No. 4671884)).

Additionally, another configuration has been proposed. Namely, in the configuration, flexible tubes are bundled with and supported by a steel belt. Similar to the above-described configuration, the flexible tubes are bent in a U-shape and the flexible tubes can be moved to follow the movement of the carriage (e.g., Patent Document 2 (Japanese Patent Laid-Open Application No. 2008-149647)).

In the above-described configurations, the tubes are disposed above the carriage, so that the tubes do not interfere with the movement of the carriage.

Incidentally, in the inkjet recording device, an image is formed on a sheet of recording paper fed from a paper feeding unit by discharging ink droplets from the inkjet head while moving the sheet of recording paper on a platen facing the carriage in a sub-scanning direction. In the inkjet recording device, the sheet of recording paper that has moved on the platen is subsequently conveyed toward a discharging unit such as a paper discharging tray. When a conveyance failure such as paper jamming occurs, the sheet of recording paper may be removed.

For removing the recording paper that causes the conveyance failure, a space is provided in a conveyance path of the recording paper, so that the recording paper can be removed. However, the tubes in the above-described configurations are arranged in parallel with the moving direction of the carriage above the platen, and their upward positions, namely, their positions in the height direction, have been fixed to predetermined positions. Therefore, it may be difficult to enlarge the space for removing the sheet of recording paper.

FIG. 10 is a diagram illustrating the above-described circumstance. FIG. 10 shows a state where the inkjet recording device is viewed from a side surface. In FIG. 10, plural tubes A are arranged in parallel in the height direction so as to supply corresponding colors of ink. Above the platen B, both end portions of the tubes A in the conveyance direction of the sheet of recording paper (the direction indicated by the arrow), namely, the both end portions in a direction perpendicular to the main scanning direction of the carriage, are supported by corresponding tube guides C and D. One of the tube guides C and D (the tube guide indicated by the reference symbol C in FIG. 10) is disposed at a position F, at which discharging of the sheet of recording paper is started, at a side of a paper discharging guide E that discharges the sheet of recording paper that has passed through the platen B.

In FIG. 10, the position of the tube guide C is aligned with the position of the tube guide D in the height direction. Accordingly, the space H1 between the tube guide C, which is disposed at the side where the sheet of paper is discharged, and the paper discharging guide E in the height direction is limited to the space corresponding to the difference between the height of the paper discharging guide E and the height of the tube guide C, which is equal to the height of the tube guide D. Therefore, if the difference between the height of the paper discharging guide E and the height of the tube guides C and D is not sufficient for removing the sheet of recording paper, it may be difficult to remove the sheet of recording paper causing the conveyance failure on the platen B.

As a countermeasure to the problem, the following configuration has been proposed (e.g., Patent Document 3 (Japanese Registered Patent No. 2641200)). Namely, in the configuration, the tubes are disposed at a side portion of the carriage, instead of the portion above the platen. The inkjet recording device is divided into an upper unit and a lower unit. The upper unit includes the recording device main body and the carriage. The lower unit includes the ink tank. The upper unit is openable and closeable with respect to the lower unit. When the upper unit is opened, the tubes are stretched following the opening movement.

However, this configuration is different from the configuration in which the tubes are arranged above the platen.

SUMMARY OF THE INVENTION

An objective of the embodiment of the present invention is to provide an image forming device having a configuration in which tubes for supplying ink are arranged above a platen and with which a conveyance failure such as paper jamming can be resolved conveniently and the tubes automatically return to their original positions when the tubes are separated from positions where the tubes are supported.

In one aspect, there is provided an image forming device comprising:

a carriage configured to be moved in a main scanning direction, the carriage including plural recording heads configured to discharge liquid droplets and sub-tanks configured to store corresponding liquids to be supplied;

a platen disposed at a position facing nozzle surfaces of the recording heads of the carriage and having a conveyance surface for conveying a recording medium, wherein an image is formed on the recording medium by discharging the liquid droplets onto the recording medium;

flexible tubes that are extended along the main scanning direction above the platen, wherein extended portions of the flexible tubes are folded at middle portions of the extended portions in a direction perpendicular to the main scanning direction, first end portions of the extended portions are connected to the corresponding sub-tanks, and second end portions of the extended portions are connected to corresponding main tanks configured to store the corresponding liquids to be supplied to the corresponding sub-tanks;

first and second tube guides configured to support the folded extended portions of the flexible tubes at a first side of the first end portions and the folded extended portions of the flexible tubes at a second side of the second end portions, respectively, wherein the flexible tubes are arranged in a height direction;

wherein the first tube guide is disposed at a first position and the second tube guide is disposed at a second position, the first position being higher than the second position in the height direction and the first position being closer to a portion of the image forming device from which the recording medium is discharged, and wherein the tubes are supported by a thin plate-like sheet member formed of an elastic material, the thin plate-like sheet member being disposed between the tubes and the first and second tube guides, wherein the tubes are supported by the thin plate-like sheet member in a direction in which the tubes are extended by using clamp members disposed at plural positions in the first vicinity of the first end portions and in the second vicinity of the second end portions.

According to the embodiment of the present invention, the first position of the first tube guide and the second position of the second tube guide are aligned so that the first position of the first tube guide disposed at a side of a paper discharging guide becomes higher in the height direction than the second position of the second tube guide facing the first tube guide. Therefore, a space for inserting a hand directed to the platen from the side of the paper discharging guide is enlarged compared to a case where the first tube guide and the second tube guide are arranged in the horizontal direction (exactly horizontal direction). With this configuration, the sheet of recording paper that causes the paper jamming can be easily removed.

Whereas, when the first tube guide and the second tube guide having a vertical positional relationship in the height direction are utilized, since the folded portions of the tubes are obliquely arranged instead of the horizontal arrangement, the tubes may be slipped out and separated from the tube guides when an operator unintentionally touches the tubes, besides a case where the tubes are intentionally separated from the tube guides. In such a case, the portions extended from the slipped folded portions may also be slipped out from the tube guides. However, the tubes are easily returned to their original positions by elastic restoring force of the tubes and the thin plate-like sheet member supporting the tubes and by reaction force generated in the sheet member when the carriage is moved. Namely, by assuming that the slipped portion is a deformed portion and the sheet member is a beam having a constant amount of deformation, it can be found that, as a distance between a point of action of a load, which corresponds to the deformed portion, and a fixed position becomes smaller as the carriage is moved, the reaction force is increased. Therefore, as the carriage moves, the shapes of the tubes are restored to follow the direction in which the tubes are extended. In this manner, it can be prevented that the tubes interfere with the smooth movement of the carriage, unlike a case where the tubes are separated from the tube guides and kept deformed.

Other objects, features and advantages of the present invention will become more apparent from the following detailed description when read in conjunction with the accompanying drawings.

DETAILED DESCRIPTION OF THE PREFERRED EMBODIMENTS

According to the configuration disclosed in Patent Document 3, a space above the carriage during a closed state can be enlarged by opening the upper unit. The sheet of recording paper remaining on the platen can be removed by using the enlarged space. However, such arrangement of the tubes is not a configuration where the tubes are supposed to be arranged above the platen, and a failure that may occur in such a configuration is not considered.

When the configuration is adopted where the tubes are arranged above the platen, a space may be ensured for a case of the paper jamming by moving the tubes from the positions at which the tubes have been disposed. Specifically, the space is ensured by removing the tubes from the tube guides. However, in this case, if an operator fails to return the tubes to the original positions and the tubes follow the movement of the carriage, it is possible that the tubes are broken by en excessive load.

On the other hand, the tubes that are utilized are tubes having certain flexibility so that the tubes can follow the movement of the carriage. Therefore, if an extended state of the tubes along the tube guides is not retained, it is possible that the tubes are separated from the tube guides. In addition to a case of a conveyance failure where the tubes are separated for removing the sheet of recording paper, the tubes may be separated when the tubes are unintentionally touched by a hand. When the tubes have been separated from the tube guides, it is possible that the carriage is not able to be moved smoothly. In this regard, no countermeasures have been considered in the above-described patent documents. Such separation of the tubes from the tube guides may interfere with the movement of the carriage, and smooth printing may be disabled.

Figure 1:
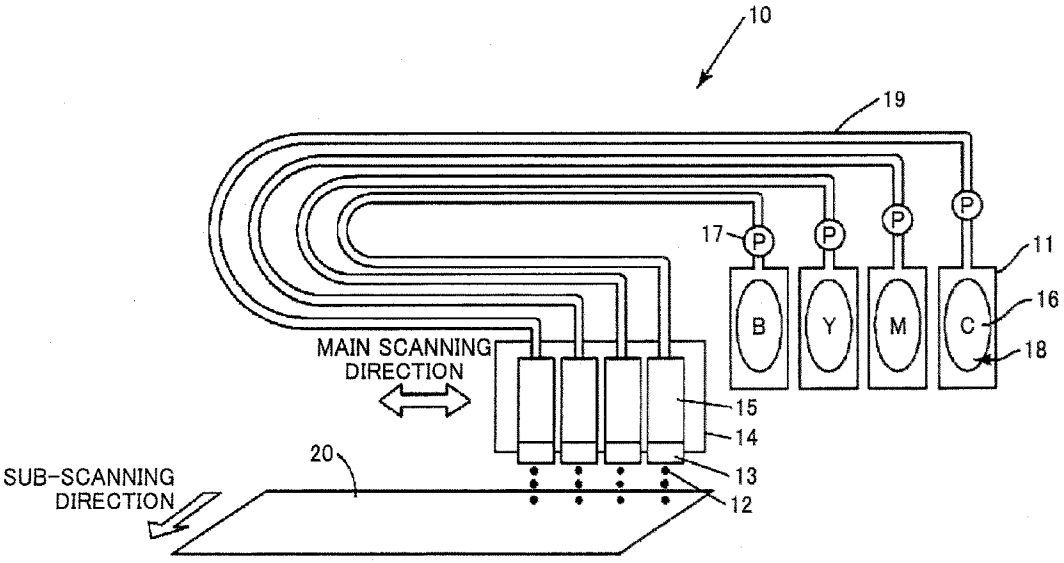
FIG. 1 is a schematic diagram illustrating an example of an image forming device according to an embodiment.

Hereinafter, there will be explained an embodiment of the present invention by referring to the accompanying drawings. FIG. 1 is a diagram showing a configuration of an inkjet recording device 10, which is an image forming device. In FIG. 1, the inkjet recording device 10 includes recording heads 13 and a carriage 14. Ink cartridges 11 for different colors supply ink to the corresponding recording heads 13. The recording heads 13 spray the corresponding colors of ink as ink droplets 12. The recording heads 13 are mounted on the carriage 14. The carriage 14 reciprocates above a sheet of recording paper 20.

Each of the recording heads 13 includes a sub-tank 15 for supplying the ink to the corresponding recording head 13. The sub-tank 15 is integrally formed with the corresponding recording head 13. Ink cartridges 11 are disposed at a position separated from the carriage 14. The ink cartridges 11 serve as main tanks. Each of the ink cartridges 11 includes an ink pack 16. The ink stored in the ink pack 16 is suctioned and conveyed by a pump 17 through a supply channel such as a tube 19, and thereby the ink is supplied to the corresponding sub-tank 15.

Figure 2:
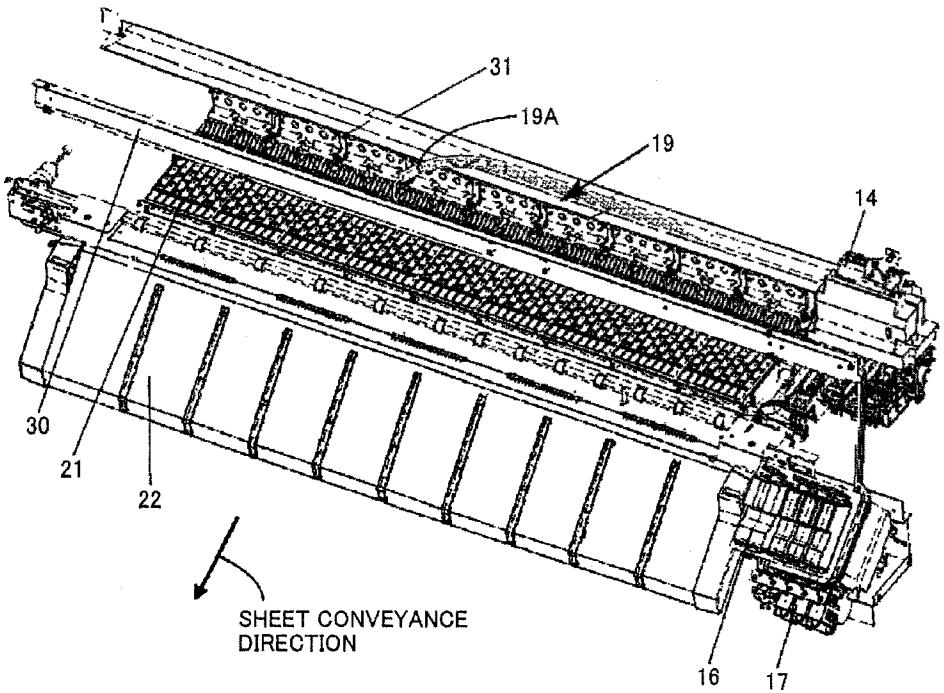
FIG. 2 is an external view showing a print unit and a paper discharge unit which are major portions of the image forming device shown in FIG. 1.
Figure 3:
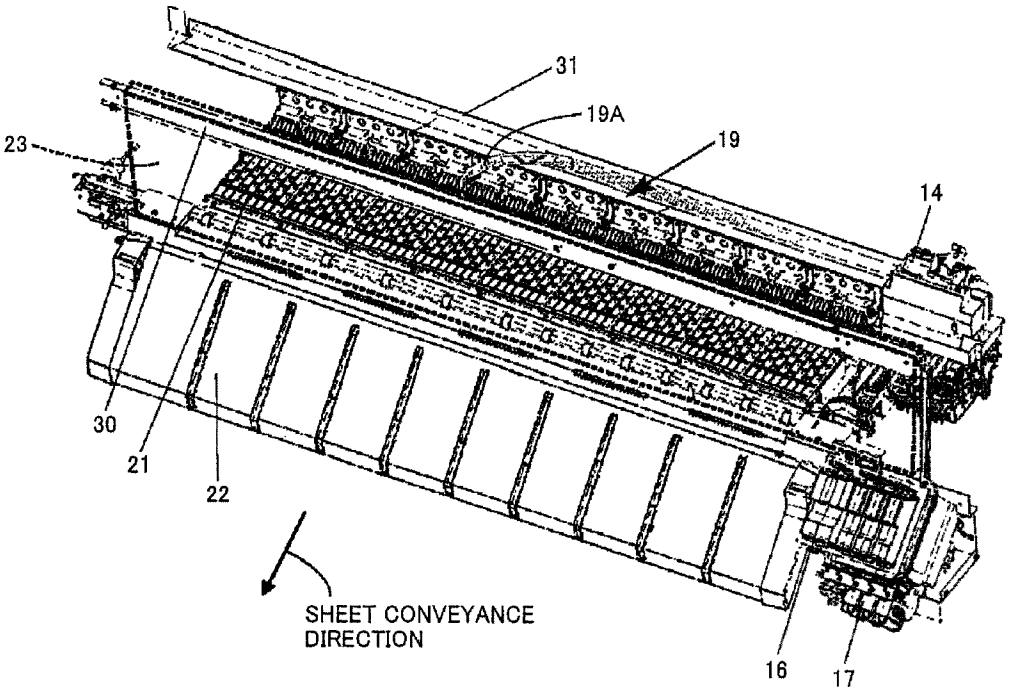
FIG. 3 is an external view showing a state where a front cover being a part of an exterior surface is disposed in front of the major portions of the image forming device shown in FIG. 2.

FIG. 2 is an external view showing major portions of the inkjet recording device 10 shown in FIG. 1. FIG. 2 shows an interior portion of the inkjet recording device 10, where a front cover indicated by the reference numeral 23 in FIG. 3 has been removed from the inkjet recording device 10. As shown in FIG. 3, the front cover 23 forms a part of exterior panels of the inkjet recording device 10. As described later, when the front cover 23 is opened, an operator can insert a hand into the interior portion. FIG. 2 shows a state where the carriage 14 shown in FIG. 1 is disposed at a home position prior to the carriage 14 being moved in a main scanning direction.

One end portions of the tubes 19 in an extended direction in which the tubes 19 are extended are connected to and fixed to the corresponding sub-tanks mounted on the carriage 14. The tubes 19 are folded at corresponding middle portions in the extended direction. The middle portions are in parallel with a sheet conveyance direction in which the sheet of recording paper 20 is conveyed. The tubes 19 have a U-shape in planar view. The other end portions of the tubes 19 in the extended direction are connected to and fixed to the corresponding ink cartridges 11. The ink cartridges 11 serve as the main tanks.

A platen 21 is disposed below the carriage 14. The sheet of recording paper 20 moves on the platen 21. A paper discharging guide 22 is disposed downstream the platen 21 in the sheet conveyance direction.

The paper discharging guide 22 is slanted downward so that free fall of the sheet of recording paper 20 by its own weight can be utilized.

As described later, the extended portions of the tubes 19 are supported by corresponding tube guides 30 and 31. The tube guide 30 is disposed downstream the tube guide 31 in the conveyance direction in which the sheet of recording paper 20 is conveyed (cf. FIG. 1). Conversely, the tube guide 31 is disposed upstream the tube guide 30 in the sheet conveyance direction. The tube guides 30 and 31 are facing each other. Namely, one folded end portions of the tubes 19 (corresponding to a position of one portion of the ti-shape, which is formed by the folded tubes 19) are supported by the tube guide 30, and the other folded end portions (corresponding to a position of the other portion of the U-shape) of the tubes 19 are supported by the tube guide 31.

FIG. 3 shows a state where a front cover 23 is disposed above the paper discharging guide 22 shown in FIG. 2. The front cover 23 can be opened and closed in the upward direction. When paper jamming occurs, the front cover 23 is opened to remove the sheet of recording paper 20.

Figure 4:
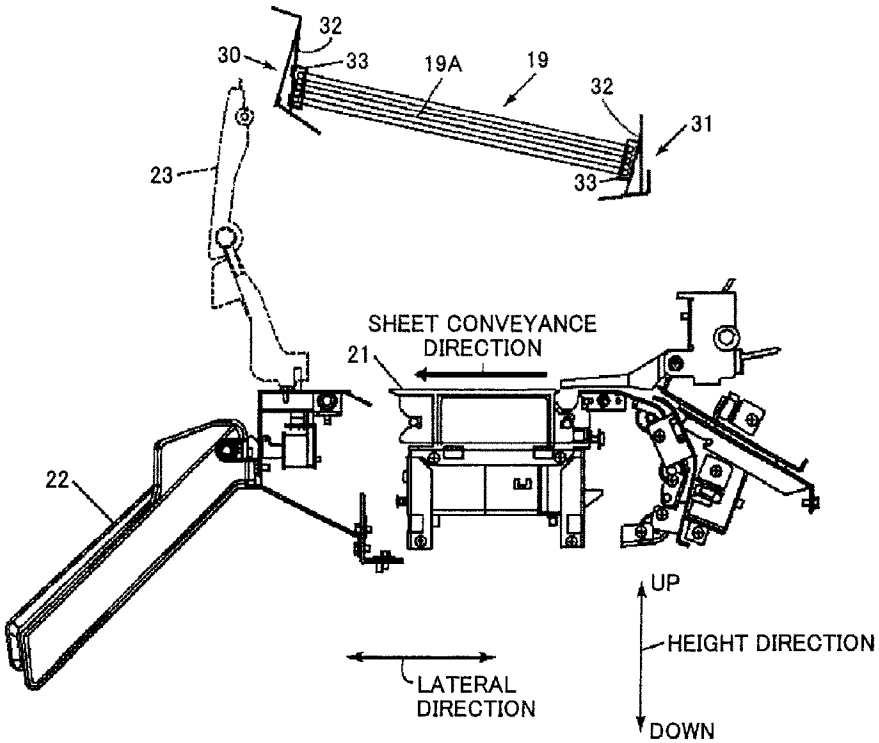
FIG. 4 is a diagram illustrating a side view of a configuration of the major portions shown in FIG. 2.

FIG. 4 shows the major portions of the image recording device 10 of FIG. 2 that are viewed from a side of the carriage 14. As shown in FIG. 4, the extended portions of the tubes 19 are disposed at corresponding end portions of a folded portion 19A of the tubes 19. Inside the front cover 23, the extended portions of the tubes 19 are supported by the corresponding first and second tube guides 30 and 31. Here, the first guide 30 disposed at the downstream position in the sheet conveyance direction (the direction indicated by the arrow) faces the second guide 31, and the second guide 31 disposed at the upstream position in the sheet conveyance direction faces the first guide 30.

As to the first and second tube guides 30 and 31, the first guide 30 is disposed at a side of the paper discharging guide 22 at which the sheet of recording paper 20 is received. Namely, the first guide 30 is disposed at the downstream position in the sheet conveyance direction. The position of the first tube guide 30 is higher in a height direction then that of the second tube guide 31 facing the first tube guide 30, thereby defining a vertical positional relationship between the first tube guide 30 and the second tube guide 31. In FIGS. 4-9, the arrows indicating the height direction are provided with indications of "UP" and "DOWN" to imply that the vertical positional relationship has been defined in the height direction.

Figure 5:
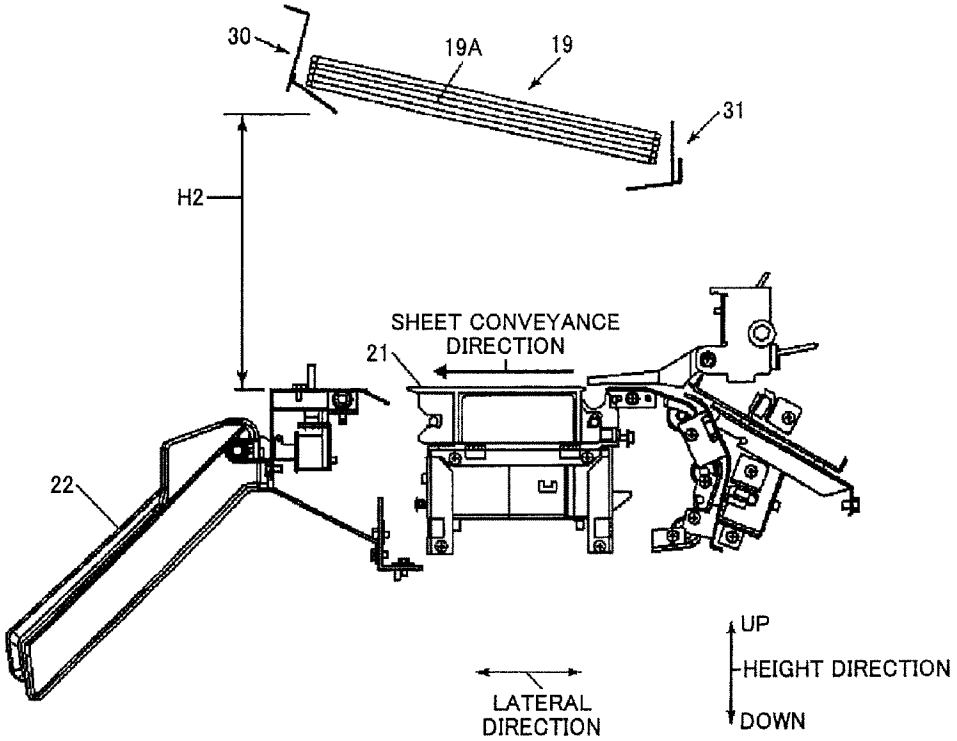
FIG. 5 is a diagram corresponding to FIG. 4 and illustrating an effect of the configuration shown in FIG. 4.
Figure 10:
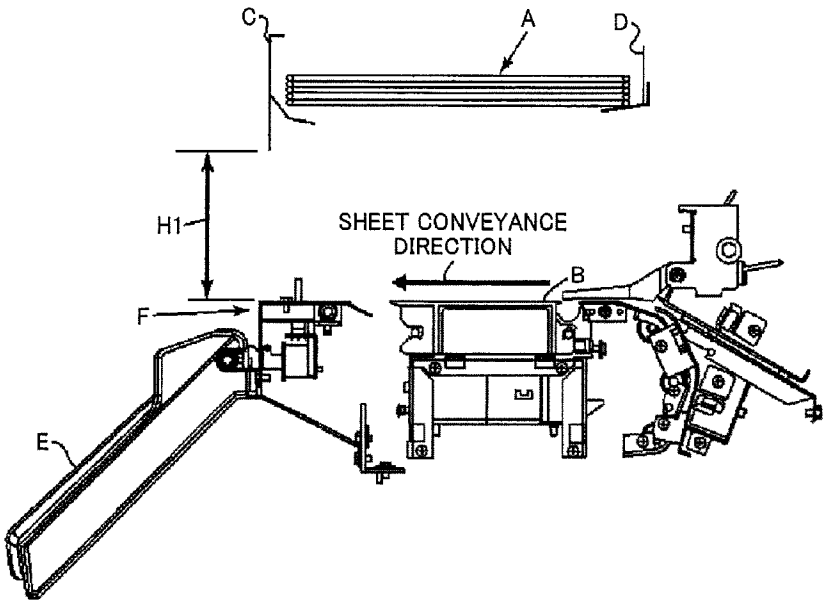
FIG. 10 is a side view illustrating a conventional tube supporting structure.

In the embodiment, as shown in FIG. 5, a space between a horizontal surface on the platen 21 and the first tube guide 30, especially, a space H2 that is ensured by the distance in the height direction is enlarged, compared to that of indicated by the reference symbol Hi in FIG. 10 in the case where the tube guides 30 and 31 are arranged exactly horizontally. In the configuration according to the embodiment, the space is enlarged for the operator for inserting the hand to remove the sheet of recording paper 20 that has caused the conveyance failure such as the paper jamming on the platen 21, thereby facilitating the removing operation of the sheet of recording paper 20.

The expansion of the space is ensured by defining the vertical positional relationship between the first and second tube guides 30 and 31. However, because of this positional relationship, the tubes 19 are slanted, and the tubes 19 are in a condition where the tubes 19 are easily slipped out from the first and second tube guides 30 and 31. Namely, such slipping out of the tubes 19 is caused by the structures of the first and second tube guides 30 and 31.

The line from the first tube guide 30 to the second tube guide 31 is slanted with respect to the horizontal line. The line is not exactly horizontal so that the first and second tube guides 30 and 31 have the vertical positional relationship. Therefore, for the first and second tube guides 30 and 31, specific supporting structures for supporting the tubes 19 have been adopted so as to respond to the slant.

Figure 6:
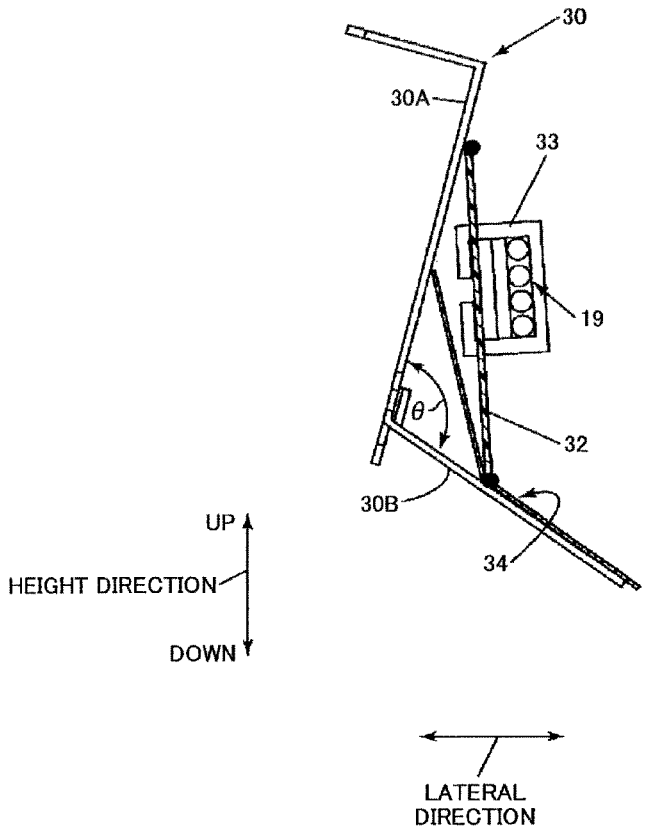
FIG. 6 is a side view illustrating details of a first tube guide used in the major portions shown in FIG. 4.
Figure 7:
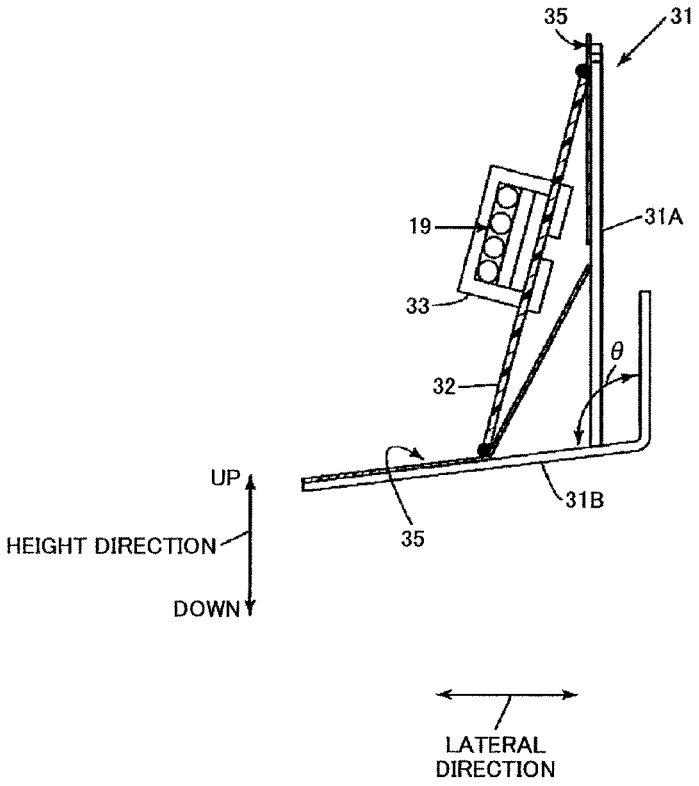
FIG. 7 is a side view illustrating details of a second tube guide used in the major portions shown in FIG. 4.
Figure 8:
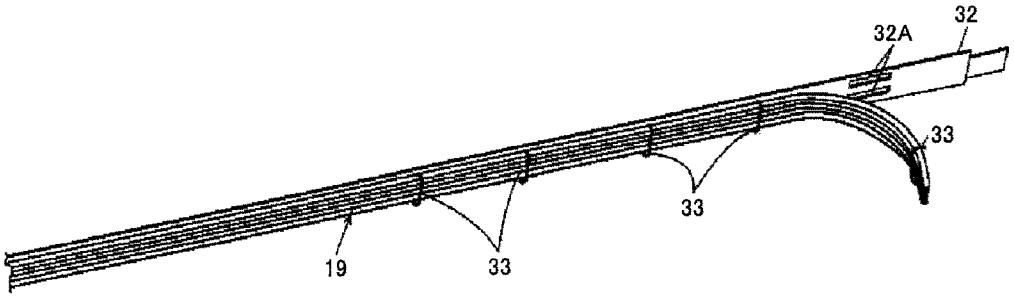
FIG. 8 is a perspective view illustrating a supporting structure of tubes used in the major portions shown in FIG. 4.

FIGS. 6 and 7 show the supporting structures of the tubes 19. Here, an arrangement of the tubes 19 will be explained prior to explaining the supporting structures of FIGS. 6 and 7. The tubes 19 are supported by the first and second tube guides 30 and 31 by the structure shown in FIG. 8. In FIG. 8, the plural tubes 19 are arranged in parallel in the height direction so as to supply the corresponding colors of ink droplets. The tubes 19 are fixed to a sheet member 32 while bundled by clamp members 33. The sheet member 32 is arranged along a surface of the tubes 19 that faces the first and second tube guides 30 and 31. The sheet member 32 is formed of an elastic thin plate-shaped member. The sheet member 32 faces the extended portions of the tubes 19 and the folded portion 19A. The clamp members 33 are disposed between the fixed end portions of the tubes 19 at the side of the carriage 14 and the fixed end portions of the tubes 19 at the side of the ink cartridges 11. The clamp members 33 fix the tubes 19 to the sheet member 32.

Since the sheet member 32 that faces the tubes 19 is disposed throughout the extended direction, the surface of the tubes 19 that faces the first and second tube guides 30 and 31 does not directly contact the first and second tube guides 30 and 31.

As shown in FIGS. 6 and 7, the cross-section of the clamp member 33 has a channel-like shape. The clamp member 33 is attached to the sheet member 32 by engaging hook-shaped portions of the clamp member 33 to corresponding engaging holes 32A of the sheet member 32. In this manner, when the clamp members 33 are engaged to the engaging holes 32A of the sheet member 32, the tubes 19 are inserted into the clamp members 33, and thereby the tubes arranged in the height direction are supported by the sheet member 32 while bundled in the height direction. A longitudinal direction of the engaging hole 32A of the sheet member 32 is set to be the direction in which the sheet member 32 is extended. The clamp member 33 engaged to the corresponding engaging hole 32A can be slid in the longitudinal direction. Since the clamp members 33 are slidable, when the clamp members 33 are disposed along the extended direction of the tubes 19 while the clamp members 33 are evenly spaced apart, positional shifts of the corresponding clamp members 33 can be corrected.

On the other hand, as shown in FIGS. 5, 6, and 7, the disposed positions of the first and second tube guides 30 and 31 in the height direction are different so that the vertical positional relationship is defined. Therefore, taking into consideration that the folded portion 19A is oblique, the first tube guide 30 is formed of a metal component including an upright portion 30A arranged along the height direction as a portion that faces the upper portion of the sheet member 32; and a lateral portion 30B as a portion that faces the lower portion of the sheet member 32. The lateral portion 30B is arranged so that an angle between the upright portion 30A and the lateral portion 30B is an obtuse angle (the angle indicated by the symbol 8 in FIG. 6). Further, the second tube guide 31 is formed of a metal component including an upright portion 31A arranged along the height direction as a portion that faces the upper portion of the sheet member 32; and a lateral portion 31B as a portion that faces the lower portion of the sheet member 32. The lateral portion 31B is arranged so that an angle between the upright portion 31A and the lateral portion 31B is an obtuse angle (the angle indicated by the symbol 8 in FIG. 7). In the configuration shown in FIG. 6, the first tube guide 30 is formed of a single plate member that has been bent in the obtuse angle. Similarly, in the configuration shown in FIG. 7, the second tube guide 31 is formed of a single plate member that has been bent in the obtuse angle. The number of the bent portions of the first tube guide 30 is greater than the number of the bent portions of the second tube guide 31.

With these configurations, the lower end in the height direction of the sheet member 32, which is slanted due to holding the slanted tubes 19, can contact the lateral portions 30B and 31B of the corresponding tube guides 30 and 31. Additionally, the upper end in the height direction of the slanted sheet member 32 can contact the upright portions 30A and 31A of the corresponding tube guides 30 and 31.

The pressing force of the sheet member 32 to contact the corresponding portions of the tube guides 30 and 31 is obtained by the shape restoring force due to the elasticity generated by folding the sheet member 32 at the middle portion in the extended direction. Namely, the pressing force is obtained by utilizing the restoring force of the sheet member 32 to recover its original linear shape. Therefore, by the pressing force in the horizontal direction caused by the shape restoring force and the gravitational force, the sheet member 32 contacts the upright portion 30A along the height direction and the lateral portion 30B of the first tube guide 30 at the positions shown by the corresponding black dots in FIG. 6. Additionally, the sheet member 32 contacts the upright portion 31A along the height direction and the lateral portion 31B of the second tube guide 31 at the positions shown by the corresponding black dots in FIG. 7. Here, the sheet member 32 remains movable while contacting the first and second tube guides 30 and 31 at the positions indicated by the corresponding black dots.

A film or sheet 34 for reducing sliding friction is attached to the upright portion 30A and the lateral portion 30B of the first tube guide 30 which are contacted by the sheet member 32. Similarly, a film or sheet 35 for reducing the sliding friction is attached to the upright portion 31A and the lateral portion 31B of the second tube guide 31 which are also contacted by the sheet member 32. The film or sheet 34 is extended from the lateral portion 30B to the upright portion 30A of the first tube guide 30 so as to cover both the upright portion 30A and the lateral portion 30B. The film or sheet 34 is extended along the lateral portion 30B. The film or sheet 34 is bent at a position on the lateral portion 30B corresponding to a middle position of a line along the lateral portion 30B that reaches the upright portion 30A, and the film or sheet 34 reaches a part of the upright portion 30A. Similarly, the film or sheet 35 is extended from the lateral portion 31B to the upright portion 31A of the second tube guide 31 so as to cover both the upright portion 31A and the lateral portion 31B. The film or sheet 35 is extended along the lateral portion 31B. The film or sheet 35 is bent at a position on the lateral portion 31B corresponding to a middle position of a line along the lateral portion 31B that reaches the upright portion 31A, and the film or sheet 35 reaches a part of the upright portion 31A. With these configurations, the friction to the sheet member 32 is reduced, when the sheet member 32 is moved on the surfaces of the first and second tube guides 30 and 31. Here, the sheet member 32 is pressed toward the corresponding portions of the first and the second tube guides 30 and 31 by the shape restoring force.

With the configurations of the first and second tube guides 30 and 31, especially, since a tip of the lateral portion 30B is directed downward in the first tube guide 30 arranged at the higher position in the height direction, it is possible that the sheet member 32 is slipped out from the lateral portion 30B. As described above, intentional separation of the tubes 19 from the tube guides 30 and 31 for removing the sheet of recording paper 20 that has caused a conveyance failure and unintentional contact by a hand of an operator can be considered as the causes of the slipping out.

Therefore, in the embodiment, not only the pressing force generated by the shape restoring force of the tubes 19 and the sheet member 32 supporting the tubes 19, but also the reaction force is utilized to restore the tubes 19 that have slipped out from the first and second tube guides 30 and 31 to the original positions. The reaction force increases as the distance between the fixed positions of the tubes 19 and the point of action of the load corresponding to the slipped out portion becomes shorter.

Hereinafter, there will be explained the reason that the tubes 19 that have slipped out from the tube guides 30 and 31 can be restored to the original positions by the pressing force and the reaction force. When the tubes 19 are separated from the first and second tube guides 30 and 31, since an exterior portion of the device main body is disposed above the first and second tube guides 30 and 31, there is no space for the tubes 19 to move upward, whereas the tubes 19 do not separate from the first and second tube guides 30 and 31 in the upward direction. Therefore, the tubes 19 tend to slip out in the downward direction.

Figure 9:
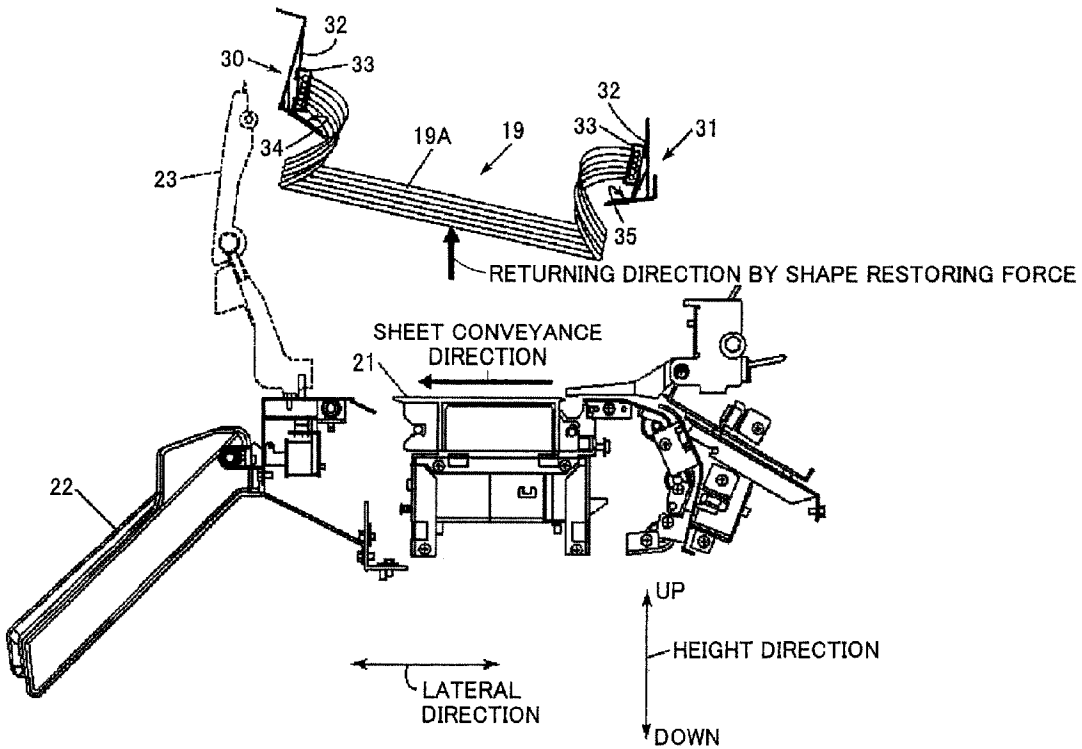
FIG. 9 is a side view illustrating an effect of the supporting structure shown in FIG. 8.

FIG. 9 shows this state. In FIG. 9, the folded portion 19A of the tubes 19 is separated from the first and the second tube guides 30 and 31. Here, the folded portion 19A is disposed at a position separated from the fixed positions of the tubes 19 and the positions of the tubes 19 in the extended direction where the corresponding end portions of the tubes 19 are supported by the sheet member 32. The fixed positions of the tubes 19 correspond to the end portions of the tubes 19 in the extended direction, namely, the side of the sub-tank 15 and the side of the ink cartridge 11.

In this case, the sheet member 32 tends to return the slipped out portion to the position along the extended direction by the shape restoring force generated by the elasticity. Namely, when the pressing force of the sheet member 32 to press toward the first and second tube guides 30 and 31 is greater than the force to slip out, the slipped out portion of the sheet member 32 tends to return to the position along the extended direction.

On the other hand, when the carriage 14 moves while the folded portion 19A has slipped out, the force generated at the sides of the fixed positions of the tubes 19 may be regarded as action of the reaction force that acts on a beam. When an amount of the deformation (separated amount) at the point of action of the load is constant and if the carriage 14 and the folded portion 19A that has slipped out are assumed to be the beam, the length of the whole beam (the distance between the point of action of the load and the fixed points) varies as the carriage 14 moves. In this case, the length of the whole beam is shortened. Accordingly, the reaction force of the sheet 32 increases depending on the position of the carriage 14, as the carriage 14 moves. Because of the shape restoring force and the increase in the reaction force, the direction of the folded portion 19A changes from the direction in which the folded portion 19 has slipped out to the extended direction, and thereby the position of the sheet member 32 is returned to its original position along the first and second tube guides 30 and 31.

Accordingly, as the reaction force generated in the sheet member 32 increases, the folded portion 19A of the tubes 19 that has slipped out returns to the position along the extended direction, where the extended portions of the tubes 19 are arranged along the first and second tube guides 30 and 31. In this manner, the original positions of the tubes 19 are restored from the slipped out state.

Consequently, the resistance during moving the carriage 14 is prevented from increasing, and thereby the smooth movement of the carriage 14 is maintained. Here, the resistance is due to the state of the tubes 19, such as the state where the tubes 19 that have slipped out contact a peripheral portion or the state where the tubes 19 are removed and dropped, other than the state where the tubes 19 are guided by the first and the second guides 30 and 31.

In the embodiment, the tubes that have slipped out from the first and second tube guides 30 and 31 can be returned to their original positions by using the increase of the reaction force in the sheet member 32. Therefore, the smooth movement of the carriage 14 can be maintained without providing special guide members to prevent the tubes from slipping out.

Hereinabove, the image forming device has been explained by the embodiment. However, the present invention is not limited to the above-described embodiment, and various modifications and improvements may be made within the scope of the present invention.

The present application is based on Japanese Priority Application No. 2011-257096 filed on Nov. 25, 2011, the entire contents of which are hereby incorporated herein by reference.

What is claimed is:

1. An image forming device comprising:

a carriage configured to be moved in a main scanning direction, the carriage including plural recording heads configured to discharge liquid droplets and sub-tanks configured to store corresponding liquids to be supplied;

a platen disposed at a position facing nozzle surfaces of the recording heads of the carriage and having a conveyance surface for conveying a recording medium, wherein an image is formed on the recording medium by discharging the liquid droplets onto the recording medium;

flexible tubes including first and second end portions that extend along the main scanning direction above the platen and including middle portions that are parallel with a direction perpendicular to the main scanning direction, wherein the first end portions are connected to the corresponding sub-tanks, and the second end portions are connected to corresponding main tanks configured to store the corresponding liquids to be supplied to the corresponding sub-tanks;

first and second tube guides configured to support portions of the flexible tubes at a first side of the first end portions and to support portions of the flexible tubes at a second side of the second end portions, respectively, wherein the flexible tubes are arranged, one above another, in a height direction that is perpendicular to the main scanning direction and perpendicular to the direction of the middle portions;

wherein the first tube guide is disposed at a first position and the second tube guide is disposed at a second position, the first position being higher than the second position in the height direction and the first position being closer to a portion of the image forming device from which in use the recording medium is discharged, wherein the tubes are supported by a thin plate-like sheet member formed of an elastic material, the thin plate-like sheet member being disposed between the tubes and the first and second tube guides, wherein the tubes are fixed to the thin plate-like sheet member in a direction in which the tubes extend by clamp members disposed at plural positions in the first vicinity of the first end portions and in the second vicinity of the second end portions, wherein the first tube guide is disposed downstream of the second tube guide in the direction perpendicular to the main scanning direction, and the first and second tube guides face each other, wherein the first tube guide comprises a metal component including an upright portion arranged along the height direction and a lateral portion arranged so that an angle between the upright portion and the lateral portion is an obtuse angle, and the second tube guide comprises a metal component including an upright portion arranged along the height direction and a lateral portion arranged so that an angle between the upright portion and the lateral portion is an obtuse angle, and the first and second tube guides face respective portions of the thin plate-like sheet member, and wherein the tubes are slanted such that a lower end in the height direction of the thin plate-like sheet member, which is slanted due to holding the slanted tubes, contacts the lateral portions of the corresponding first and second tube guides and an upper end in the height direction of the slanted thin plate-like sheet member contacts the upright portions of the corresponding first and second tube guides.

2. The image forming device according to claim 1, wherein a first film or a first sheet configured to reduce sliding friction is attached to a first surface of the first tube guide, wherein end portions in the height direction of the thin plate-like sheet member contact the first surface, and wherein a second film or a second sheet configured to reduce the sliding friction is attached to a second surface of the second tube guide, wherein the end portions in the height direction of the thin plate-like sheet member contact the second surface.

3. The image forming device according to claim 2, wherein the thin plate-like sheet member is slidable against the first surface of the first tube guide and the second surface of the second tube guide.

4. The image forming device according to claim 1, wherein the thin plate-like sheet member is slidable against a first surface of the first tube guide and a second surface of the second tube guide.

5. The image forming device according to claim 1, wherein the tubes are arranged at the first and second tube guides such that the tubes face the first and second tube guides in a direction which is not horizontal.

6. The image forming device according to claim 1, wherein the and second tube guides extend along the main scanning direction.

* * * * *